US006736363B2

(12) United States Patent
Field

(10) Patent No.: US 6,736,363 B2
(45) **Date of Patent: *May 18, 2004**

(54) QUICK RELEASE SUPPORTING APPARATUS FOR A CANISTER

(75) Inventor: Bradley J. Field, Kelowna (CA)

(73) Assignee: Pacific Safety Products Inc., Kelowna ( * ) Notice: Subject to any disclaimer, the term of this patent is extended or adjusted under 35 U.S.C. 154(b) by 6 days.

This patent is subject to a terminal disclaimer.

(21) Appl. No.: 10/373,176

(22) Filed: Feb. 26, 2003

(65) Prior Publication Data

US 2003/0122048 A1 Jul. 3, 2003

Related U.S. Application Data

(63) Continuation of application No. 10/046,577, filed on Jan. 16, 2002, now Pat. No. 6,543,736.
(60) Provisional application No. 60/261,205, filed on Jan. 16, 2001.

(51) Int. Cl.[7] ..... A47K 1/08
(52) U.S. Cl. ..... 248/313
(58) Field of Search ..... 248/313, 311.2, 248/317, 686, 689

(56) References Cited

U.S. PATENT DOCUMENTS 5,810,309 A * 9/1998 Augustine et al. ..... 248/313
6,543,736 B2 * 4/2003 Field ..... 248/313

* cited by examiner

*Primary Examiner*—Leslie A. Braun
*Assistant Examiner*—A. Joseph Wujciak, III
(74) *Attorney, Agent, or Firm*—Antony C. Edwards

(57) ABSTRACT

The quick release canister supporting apparatus includes a mounting bracket mountable to a rigid support, a rigid, canister retaining frame releasably mountable into mating engagement with the mounting bracket, and at least one latch cooperating between the mounting bracket and the retaining frame for the releasable mounting into mating engagement of the retaining frame with the mounting bracket. The latch may be mounted to the mounting bracket or to the retaining frame. A manually operable release actuator cooperates with the latch for selective actuation of the latch to release the retaining frame from the mounting bracket. The retaining frame defines a rigid cavity having an opening for receiving a gas canister substantially completely into the cavity. The retaining frame includes at least one selectively releasable canister rotation restraint for inhibiting rotation and sliding of the canister about and along its longitudinal axis. At least one selectively releasable canister ejection restraint may also be provided for inhibiting sliding ejection of the canister from the cavity.

12 Claims, 24 Drawing Sheets

QUICK RELEASE SUPPORTING APPARATUS FOR A CANISTER

CROSS REFERENCE TO RELATED APPLICATION

This application is a Continuation of U.S. patent application Ser. No. 10/046,577 filed Jan. 16, 2002 now U.S. Pat. No. 6,543,736 which claims priority from U.S. Provisional Patent Application No. 60/261,205 filed Jan. 16, 2001 entitled Quick Release Supporting Apparatus for a Canister.

FIELD OF THE INVENTION

This invention relates to an apparatus for releasably mounting a cylindrical oxygen canister for rapid deployment and use.

BACKGROUND OF THE INVENTION

There are many examples, one of which is an emergency response vehicle, where it is desirable to have a cylindrical gas canister, such as an oxygen or fire retardant canister, mounted so as to be out of the way, and whereso mounted ready for rapid deployment and use. Other examples may include medical emergency rooms, or other static or mobile facilities whether medical or otherwise.

In the emergency vehicle example, such vehicles are often required to transport canisters containing pressurized gaseous substances such as air, oxygen or fire suppressant materials. Such canisters generally have at one end of the canister end fittings such as valves and pressure regulators or the like which can become damaged. These types of canisters may be generally cylindrically shaped and if left free standing may be relatively easily knocked over. When such canisters are transported by emergency vehicles a suitable means of restraint is needed to secure the canisters within the vehicle in a manner which permits rapid release of the canister for use. It is also preferable to provide for ease of carrying by emergency personnel and for stable deployment of the canister at the destination.

In the prior art applicant is aware of U.S. Pat. No. 5,354,029 which discloses a frame mountable within an emergency vehicle. The frame has two pairs of spaced apart 'clam shell' clamps, operable by a lever, and designed to engage a back-pack style of air tank such as is normally worn by fire-fighters while seated within an emergency vehicle. Placement of the cylinder within the device is cumbersome; and the device does not permit emergency personnel to easily carry the cylinder to the point of use, nor does it provide a means of stable deployment for the cylinder on the ground at the point of use.

Thus, it is an object of the present invention to provide a latching means for releasable mounting of cylindrical canisters which allows case of insertion, automatic locking and a one hand operated quick release mechanism.

Further, without intending to be limiting, an additional object of this invention is to provide a retaining assembly which can be readily secured to a canister, which will facilitate rapid mating engagement of the canister with the quick release mechanism and which may provide both a carrying and supporting apparatus for the canister.

As used herein, reference to canister is intended to include reference to tank, cylinder or like references to containers for pressurized gas.

SUMMARY OF THE INVENTION

The quick release of the quick release supporting apparatus of the present invention may include both a bracket and a latch. The latch may have a latch pawl mounted intermediate the ends of a spindle so as to be rotatably nested within a latch receiving arm of the bracket. A manually operable lever arm may be provided to rotate the latch pawl into an open position. The lever arm may be operable by depressing a button mounted to the arm or by pulling a handle mounted to the arm or by other biasing devices for rotating the lever arm or for operating the latch pawl. A cover may be mounted over the bracket and latch mechanism. Spaced apart aligned apertures in the cover permit the supporting arm and latch receiving arm to protrude through.

A canister retaining frame may have upper and lower annular collars or clamps for receiving therein a gas canister. The collars may each have a protrusion, for example opposite the latch when the retaining frame is mounted therein, for supporting a longitudinal tubular handle therebetween. Outwardly extending arms on each collar, which may be oppositely disposed relative to the protrusions, form a pair of forks or yokes. A pin is mounted across each fork or yoke. In one embodiment where the collars provide for clamping of the canister, the pin in each yoke is fixed in one arm of the yoke, and is slidably journalled through the other arm. An over-center cam faced lever is mounted to the outer end of the pin. The arms of the yoke allow tightening of the collar around the canister by the clamping action of the cam lever. The upper and lower annular collars are spaced apart along the canister so as to better support the canister and to allow the corresponding upper and lower pins to engage and mate with the latch receiving arm and a support arm, respectively, formed on opposite ends of the bracket.

A transverse handle and regulator guard frame combination, collectively referred to herein as a regulator guard, may be mounted to the upper end of the oxygen canister retaining frame. The guard is a rigid frame protecting the regulator and providing for ease of grasping and manipulating the end of the canister when in the retaining frame. By way of example, the guard frame may be of tubular material and may be rectangular or may be curved so as to loop around the circular circumferential profile of the canister.

Supporting legs, which automatically deploy when an end of the canister retaining frame is placed in contact with a firm surface, may be pivotally mounted on the canister retaining frame, for example between the upper and lower collars. Placing the retaining frame on the firm surface drives linkage arms upwardly. The linkage arms are rotatably mounted to the supporting legs so as to pivot the supporting legs outwardly of the retaining frame as the linkage arms are translated upwardly relative to the retaining frame.

In summary, the quick release canister supporting apparatus of the present invention includes a mounting bracket mountable to a rigid support, a rigid, canister retaining frame releasably mountable into mating engagement with the mounting bracket, and at least one latch cooperating between the mounting bracket and the retaining frame for the releasable mounting into mating engagement of the retaining frame with the mounting bracket The latch may be mounted to the mounting bracket or to the retaining frame. A manually operable release actuator cooperates with the latch for selective actuation of the latch to release the retaining frame from the mounting bracket. The retaining frame defines a rigid cavity having an opening for receiving a gas canister substantially completely into the cavity. The retaining frame includes at least one selectively releasable canister rotation restraint for inhibiting rotation and sliding of the canister about and along its longitudinal axis. At least one selectively releasable canister restraint may also be provided for inhibiting sliding of the canister from the cavity.

A portion of the retaining frame, which may be oriented generally opposite the mounting bracket when the retaining frame is mounted to the mounting bracket, provides a carry handle for carrying of the retaining frame by a user when the canister is mounted in the cavity and the retaining frame is dismounted from the mounting bracket. A rigid regulator guard is mounted to the retaining frame at a first end of the retaining frame corresponding to the opening to the cavity. The guard extends over the opening so as to protect a gas flow regulator mounted on the canister.

In one embodiment, the latch is mounted to the mounting bracket and is a single upper latch disposed substantially vertically above a support arm extending from the bracket, where the support arm is adapted to releasably engage and support a lower end of the frame. An upper end of the retaining frame is adapted to releasably engage the latch.

The frame may include first and second collars, mounted in or to or forming part of the retaining frame. The collars are parallel and spaced apart. Corresponding first and second apertures defined by the collars are co-axial along a longitudinal axis of the canister when mounted journalled in the collars. Rigid, parallel first and second cross-members may be mounted to the first and second collars respectively. The first and second cross members are for releasable mating with the latch and the supporting arm respectively.

The latch may be mounted to the mounting bracket so as to protrude cantilevered therefrom. Thus, where the mounting bracket mounts to a rear surface of a rigid support such as a wall or mounting plate, and the rigid support is apertured so that the latch may extend through corresponding apertures in the wall to protrude from the opposite front surface of the wall, the front surface of the wall is adapted for releasable latched mating with the rigid frame.

The mounting plate may be an angled wall mount adapted for mounting to the wall. The mounting bracket may then be mounted to the wall mount along a surface of the wall mount inclined relative to the wall so as to incline the retaining frame towards and along the wall when the retaining frame is mounted to the mounting bracket.

A resilient compression fit auxiliary latch may be provided cooperating with the latch so as to provide a safety backup latch for controlled release of the retaining frame from mounting to the mounting bracket.

DETAILED DESCRIPTION OF EMBODIMENTS OF THE INVENTION

Figure 2:
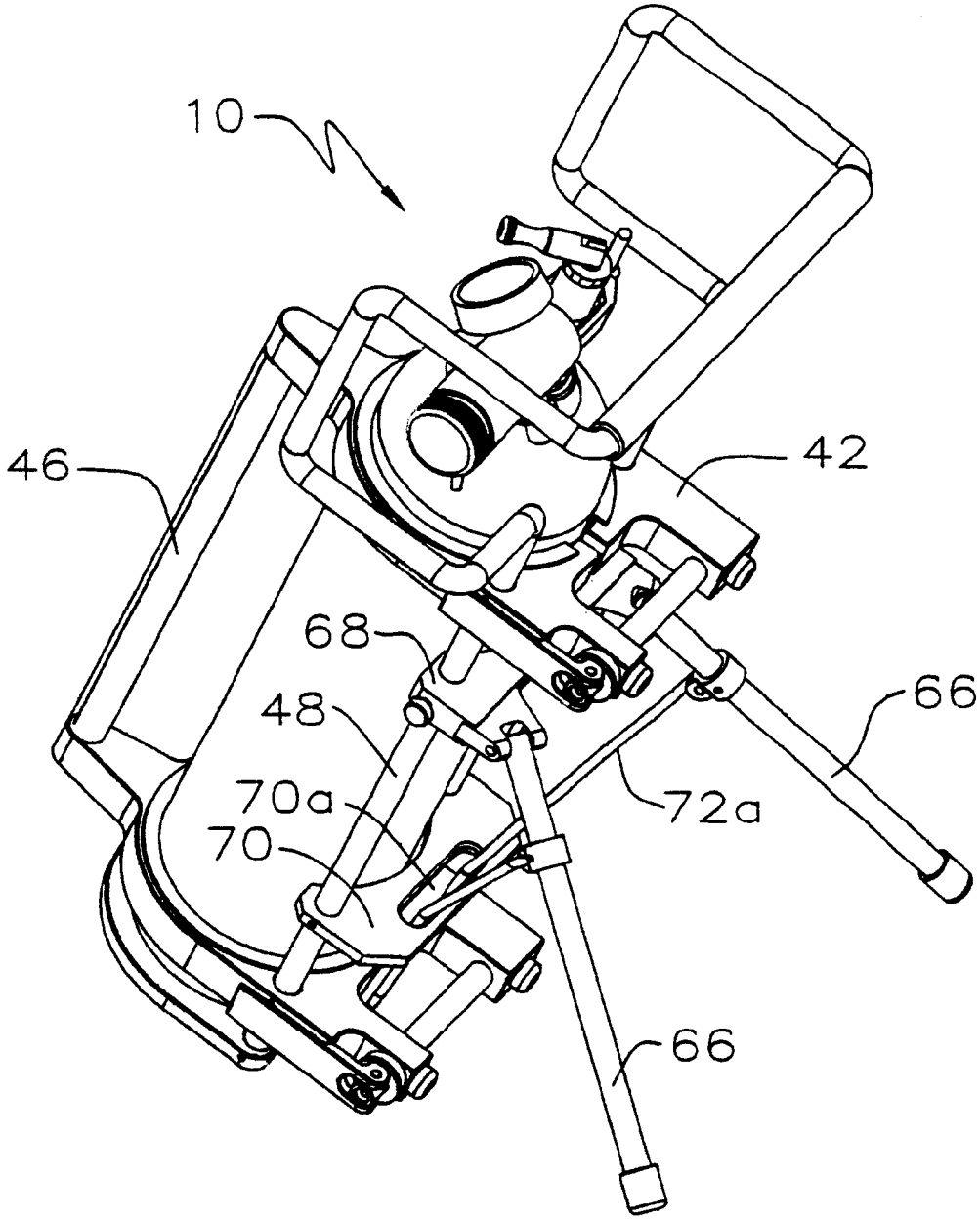
FIG. 2 is an isometric view of the present invention with the supporting legs in a deployed aspect.
Figure 3:
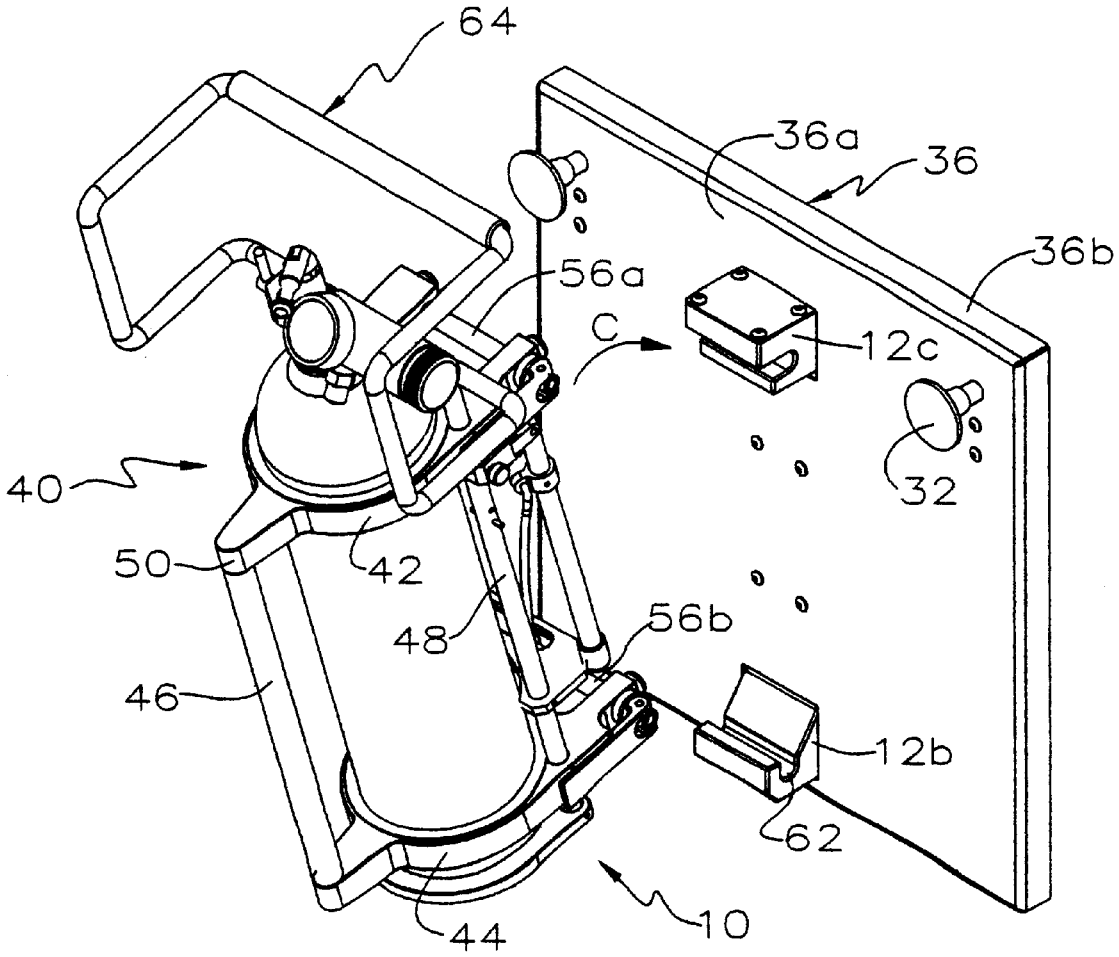
FIG. 3 is an isometric view of the present invention positioned in proximity to the mounting bracket and latching mechanism; portions of which are protruding through the cover plate.
Figure 4:
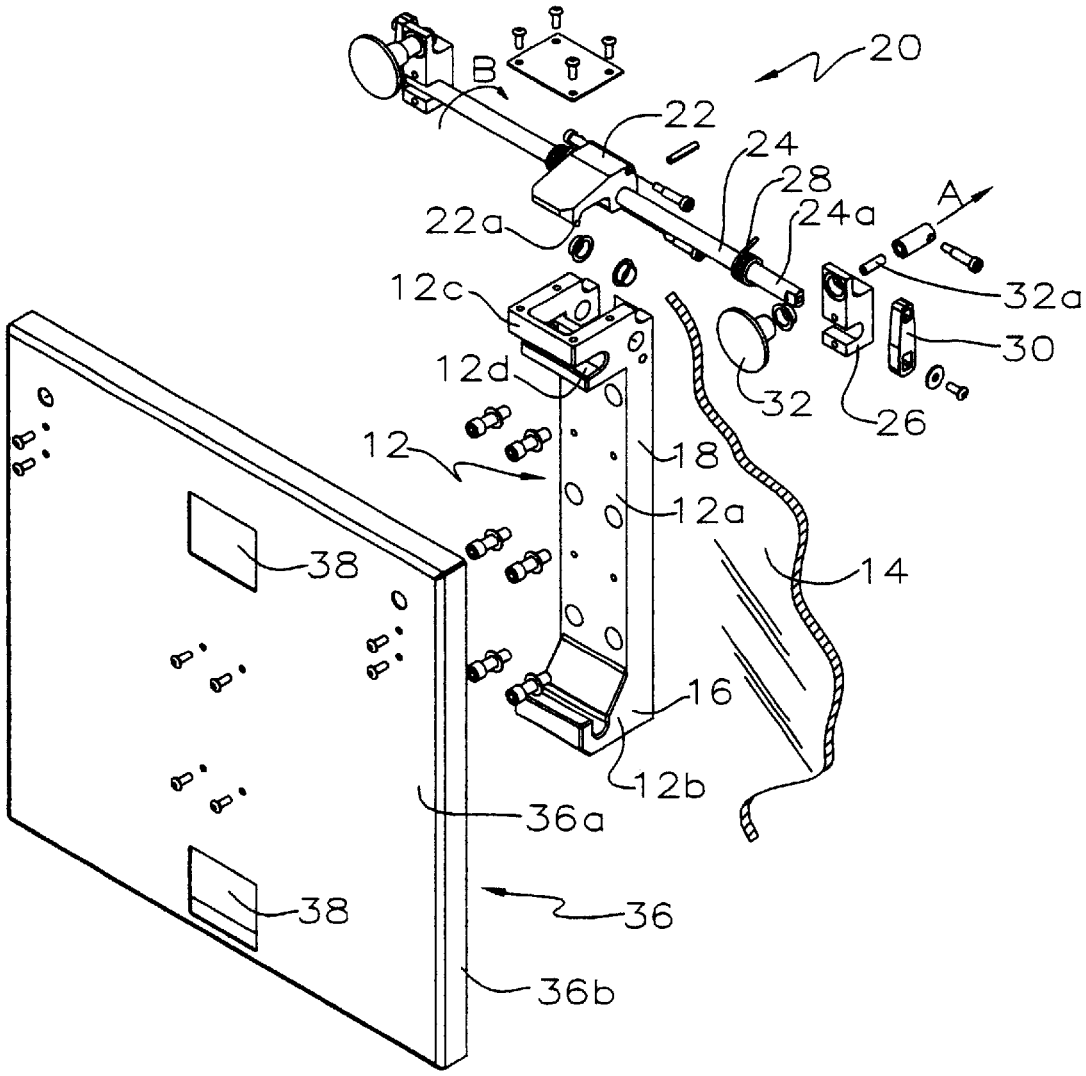
FIG. 4 is an exploded isometric view of the mounting bracket, latching mechanism and cover plate.
Figure 4D:
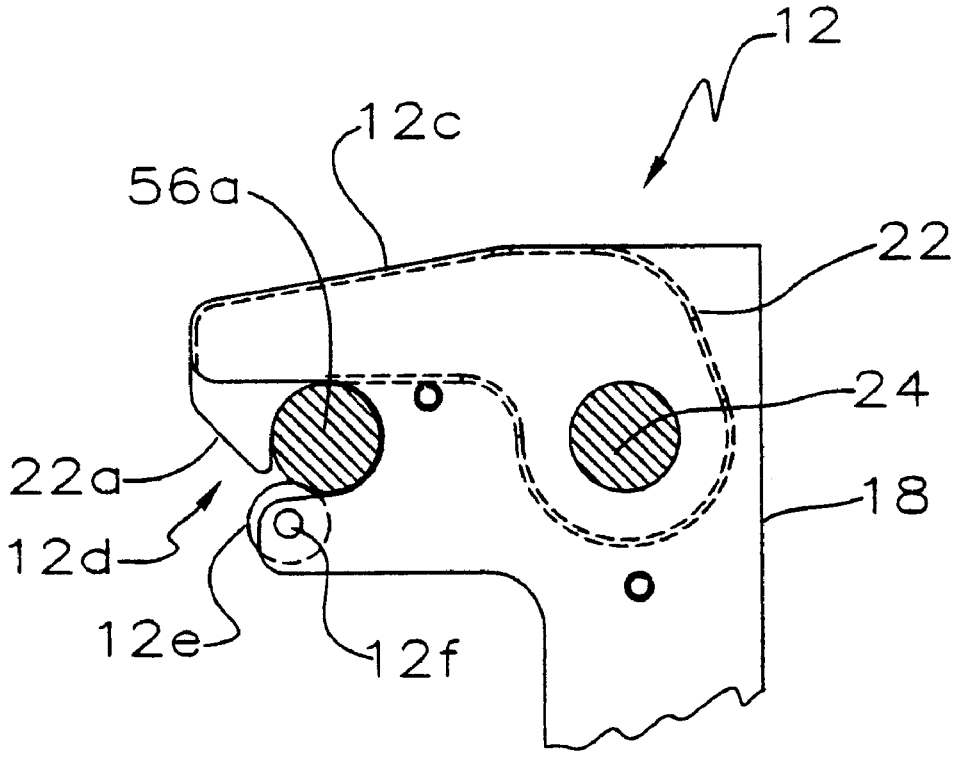
FIG. 4*a* is a sectional view of the latch pawl of the present invention.
FIG. 4*b* is a perspective view of the latch pawl of FIG. 4*a*.

With reference to the drawing figures wherein similar characters of reference denote corresponding parts in each view, as seen in FIGS. 1–4, in one embodiment a mounting bracket 12, better seen in FIG. 4, for mounting to an inside surface 14 of, for example, an emergency vehicle, provides for releasable mounting of canister support 10. Mounting bracket 12 may have an elongated body 12*a* which has formed at a first end 16, or mounted thereto, a cantilevered supporting arm 12*b*. Opposite second end 18 of body 12*a* has formed thereon or mounted thereto a cantilevered latch receiving arm 12*c*. Arms 12*b* and 12*c* may be cantilevered relative to elongated body 12*a* so as to generally extend at right angles from the mounting surface 14 when body 12*a* is mounted to surface 14. Alternatively, arms 12*b* and 12*c* may be independently mountable to surface 14 as separate parts, in which case each would have its own mounting bracket, plate or other attachment means (collectively referred to herein as a mounting bracket).

Figure 4B:
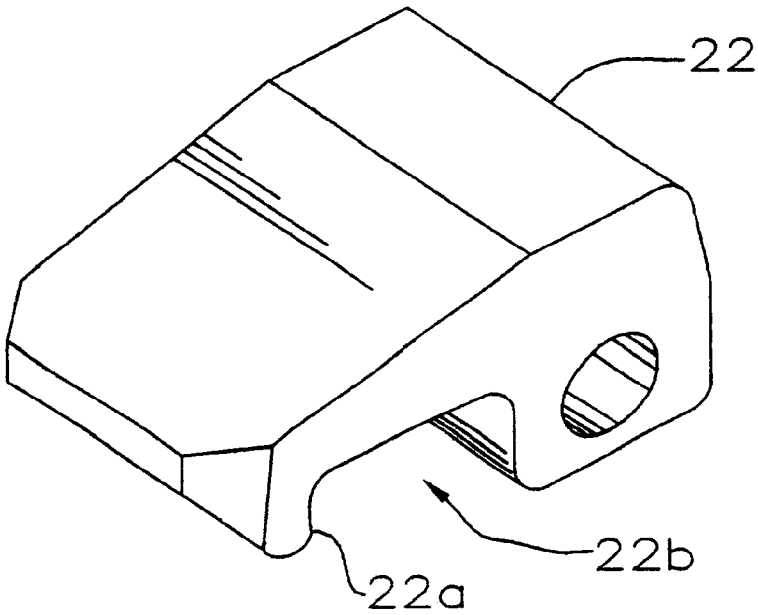

Latching mechanism 20 has a latch pawl 22 rigidly mounted to spindle 24, for example, intermediate the ends of spindle 24. Spindle 24 may be rotatably mounted to body 12*a* so as to rotatably nest pawl 22 within a cavity or recess in latch receiving arm 12*c*. Spindle 24 is rotatable against the return biasing force of springs 28 which rotationally urge latch pawl 22 into a closed position wherein pawl flange 22*a*, better seen in FIGS. 4*a* and 4*b*, is lowered into cavity or recess 12*d* in arm 12*c*. Spindle 24 is rotatably supported at its ends 24*a*, remote from the latch pawl 22, in end blocks 26 to allow free rotation of pawl 22. Release levers 30 are rigidly mounted to spindle 24 for example adjacent ends 24*a*. A release actuator such as release button 32 is mounted to shaft 32*a* which is rigidly slidably journalled through end blocks 26. Shaft 32*a* is pivotally mounted to release lever arm 30. As release lever arm 30 is rotated, such as when release button is depressed in direction A, the spindle and latch are rotated in direction B, against the return biasing force of helical biasing spring 28, to rotate latch pawl 22 into an open position wherein pawl flange 22*a* is raised or otherwise extracted from cavity 12*d* in arm 12*c*.

Resilient tube 12*e* is mounted on pin 12*f* between the lower forks of arm 12*c*. As better seen in FIG. 4*a*, pin 56*a* on retaining frame 40 snugly seats in recess 12*d* of arm 12*c* behind pawl flange 22*a*. Once pawl flange 22*a* is elevated to release the latch, allowing extraction of pin 56*a* from arm 12*c*, pin 56*a* must slightly compress tube 12*e* to pass outwardly from recess 12*d*. Tube 12*c* thus provides a safety catch. If latch pawl 22 is inadvertently actuated so as to raise pawl flange 22*a*, pin 56*a* will not merely fall out of recess 12*d*, which would then drop apparatus 10 from, for example, its wall mounting, but rather a user must then firmly pull pin 56*a* past the constriction in recess 12*d* which is smaller than the diameter of pin 56*a*, where the constriction is formed between resilient tube 12*e* and the lower edge of the upper fork of arm 12*c*.

A cover 36 having a face plate 36*a* and a perimeter lip 36*b* may be mounted over mounting bracket 12 and latching mechanism 20. Perimeter lip 36*b* spaces face plate 36*a* from surface 14 by, for example, approximately the thickness of the body 12*a*. Arms 12*b* and 12*c* extend through apertures 38 in face plate 36. Face plate 36*a* may thus be positioned in proximity to and mounted to mounting bracket 12 and end blocks 26, for example, by screws or the like.

With respect to canister retaining frame 40, upper and lower annular clamps 42 and 44 may be held in parallel alignment spaced apart along the length of canister or cylinder 60 by a tubular handle 46 and a pair of longitudinal spacing tubes 48. Annular clamps 42 and 44 may each have a radial protrusion 50 which mounts to the ends of tubular handle 46 and space the handle radially outwardly from the annular clamping surfaces of the clamps and align the handle parallel to the canister. A split 52 may be formed in each of the clamps opposite protrusion 50. A yoke 54 has arms 54*a* and 54*b* which may extend outwardly from the clamps on either side of the split 52. A pin 56 may be rigidly mounted at a first end in one arm 54*b* and slidably journalled at an opposite second end through the opposite arm 54*a*. An over-center cam lever 58 may be mounted to the second end of-pill 56. Arms 54*a* and 54*b* may then be drawn together by rotating arm lever 58 so as to engage the cam on the lever against arm 54*a*. Drawing arms 54*a* and 54*b* together tightens the annular damping surfaces of the clamps snugly around a gas cylinder 60.

The upper and lower annular clamps 42 and 44 respectively may be spaced apart by the handle 46 and hollow spacing tubes 48, or other spacers, a sufficient distance so as to position pins 56 for simultaneous or sequential mounting in latch receiving arm 12*c* and support arm 12*b*.

Lowermost pin 56*b* may be first placed in a receiving groove 62 formed in lower support arm 12*b*. The canister retaining frame 40 may then be pivoted in direction C on the lower pin 56*b* until upper pin 56*a* engages the rearward sloping leading face of pawl flange 22*a* of the latch pawl 22. Further rotation of canister retaining flame 40 forces pin 56*a* under pawl flange 22*a*, rotating the latch pawl 22 in direction B to its open position against the return torsion force of the biasing spring 28. As the upper pin 56*a* slides along cavity 12*d* past pawl flange 22*a* it aligns with and is engaged within cavity 22*b* in pawl 22 as seen in FIG. 4*a*. This allows latch pawl 22 to rotate to its closed position, that is, in a direction opposite to that of direction B, under the urging of biasing springs 28. This latches the retaining frame and associated canister firmly in place against the bracket.

Gas flow regulator guard 64 may be formed from hollow tubing and mounted to ends of hollow spacing tubes 48. The handle and guard frame 64 may extend around, so as to protect any valves, regulators, gauges or the like which are normally mounted on such canisters.

Legs 66 are supported by the hollow spacing tubes 48 on a leg support plate 68. Support plate 68 is positioned near the uppermost annular clamp 42 and is slidably mounted on the hollow spacing tubes 48. Support legs 66 are hinged to support plate 68 so as to swing outwardly from the canister retaining frame 40 on the side opposite to the tubular handle 46. A guide plate 70, positioned near lower annular clamp 44 on hollow spacing tube 48*a*, has a guide slot 70*a* through which an actuation plunger 72 extends. Actuation plunger 72 may be generally 'U' shaped and have drive rods 72*a* mounted thereto. Rods 72*a* are rotatably mounted to the support legs 66. When the base of canister retaining frame 40 is placed on a firm surface such as the ground, actuation plunger 72 contacts the firm surface and is pushed partially through guide slot 70*a* in guide plate 70 generally in a direction toward upper annular clamp 42. This drives rods 72*a* against legs 66 and results in support legs 66 rotating outwardly from the canister retaining frame 40 so as to support frame 40 in a generally upright, stable tripod position.

The automatic deploying of supporting legs 66 may be deactivated by repositioning the support plate 68, in a direction toward upper annular clamp 42, on hollow spacing tubes 48. Through such repositioning of support plate 68, actuation plunger 72 is elevated so as to avoid contact with a surface upon which canister retaining frame 40 may be placed.

Figure 5:
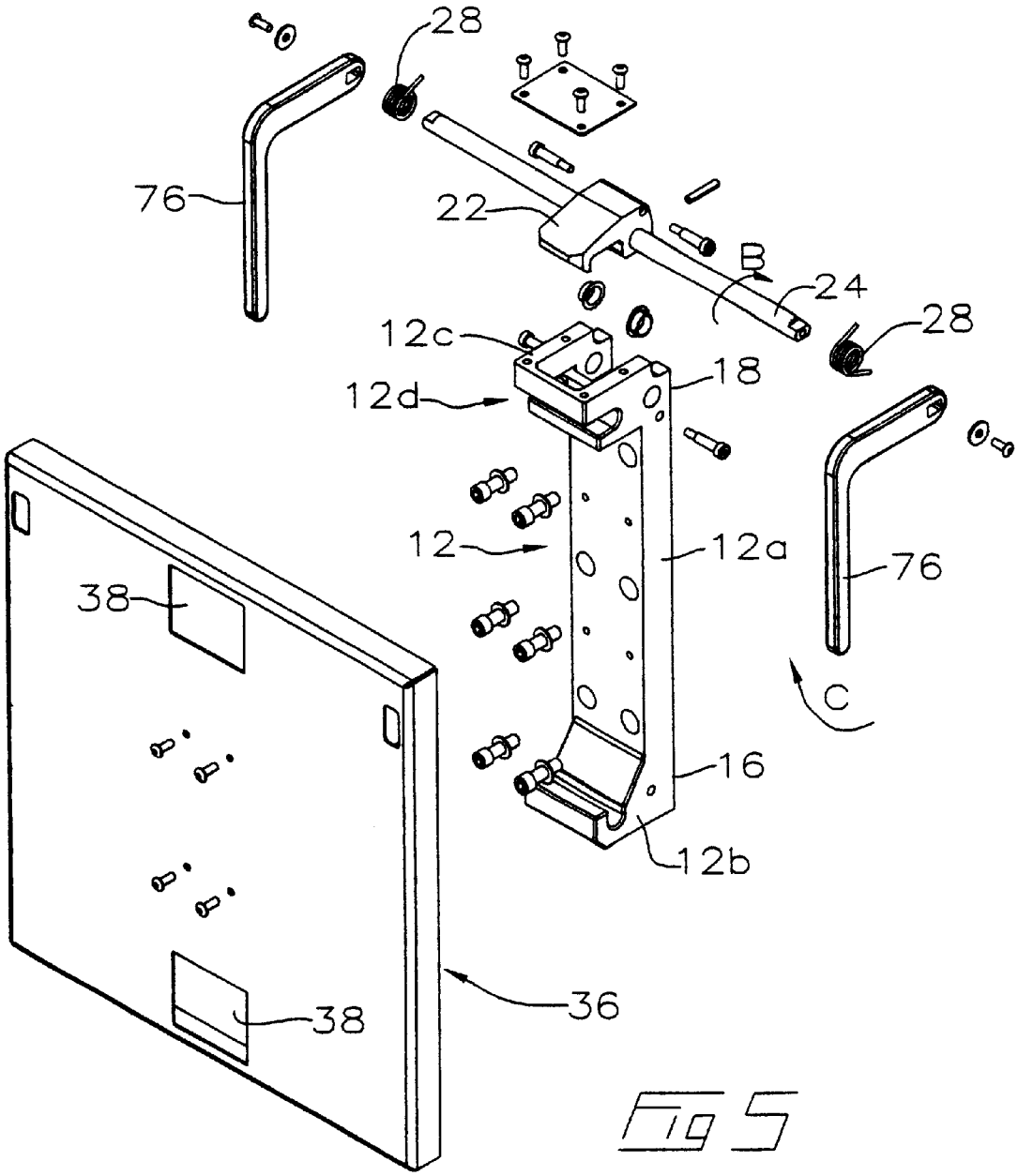
FIG. 5 is an exploded isometric view illustrating an alternative latch releasing mechanism.
Figure 5D:
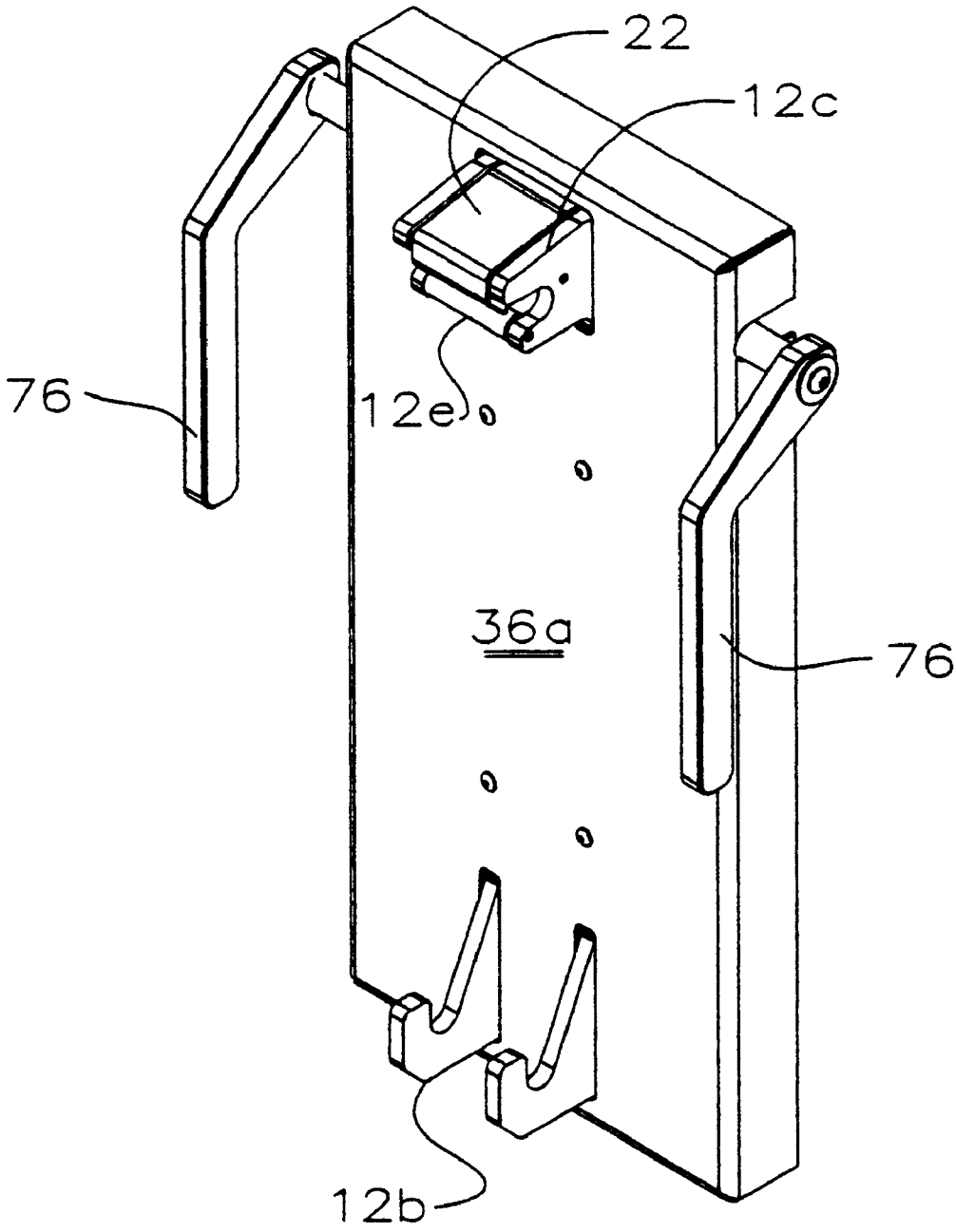
FIG. 5*a* is, in perspective view, an alternative embodiment of the mounting bracket of FIG. 5.
FIG. 5*b* is, in exploded view, the mounting bracket of FIG. 5*a*.
Figure 5B:
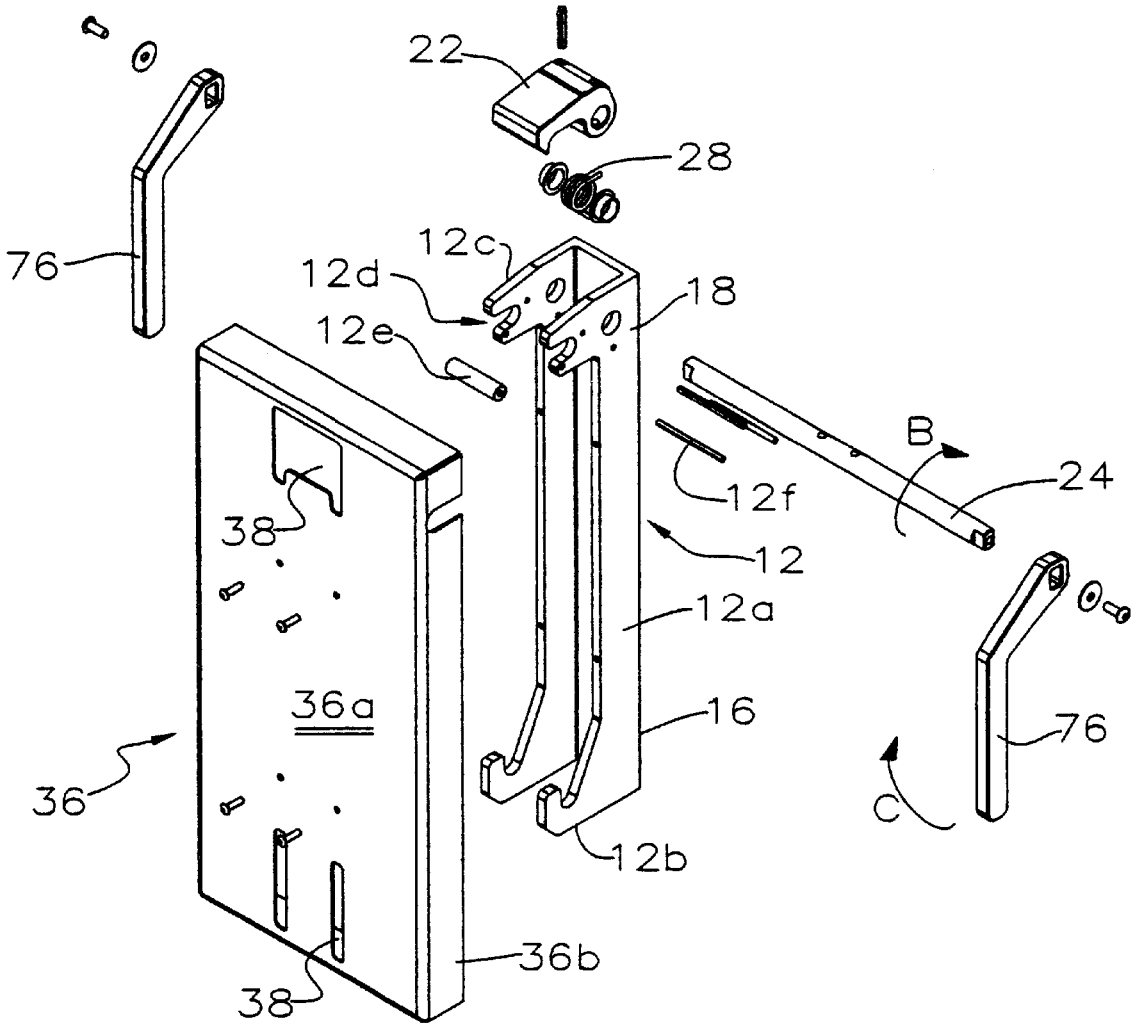
Figure 6:
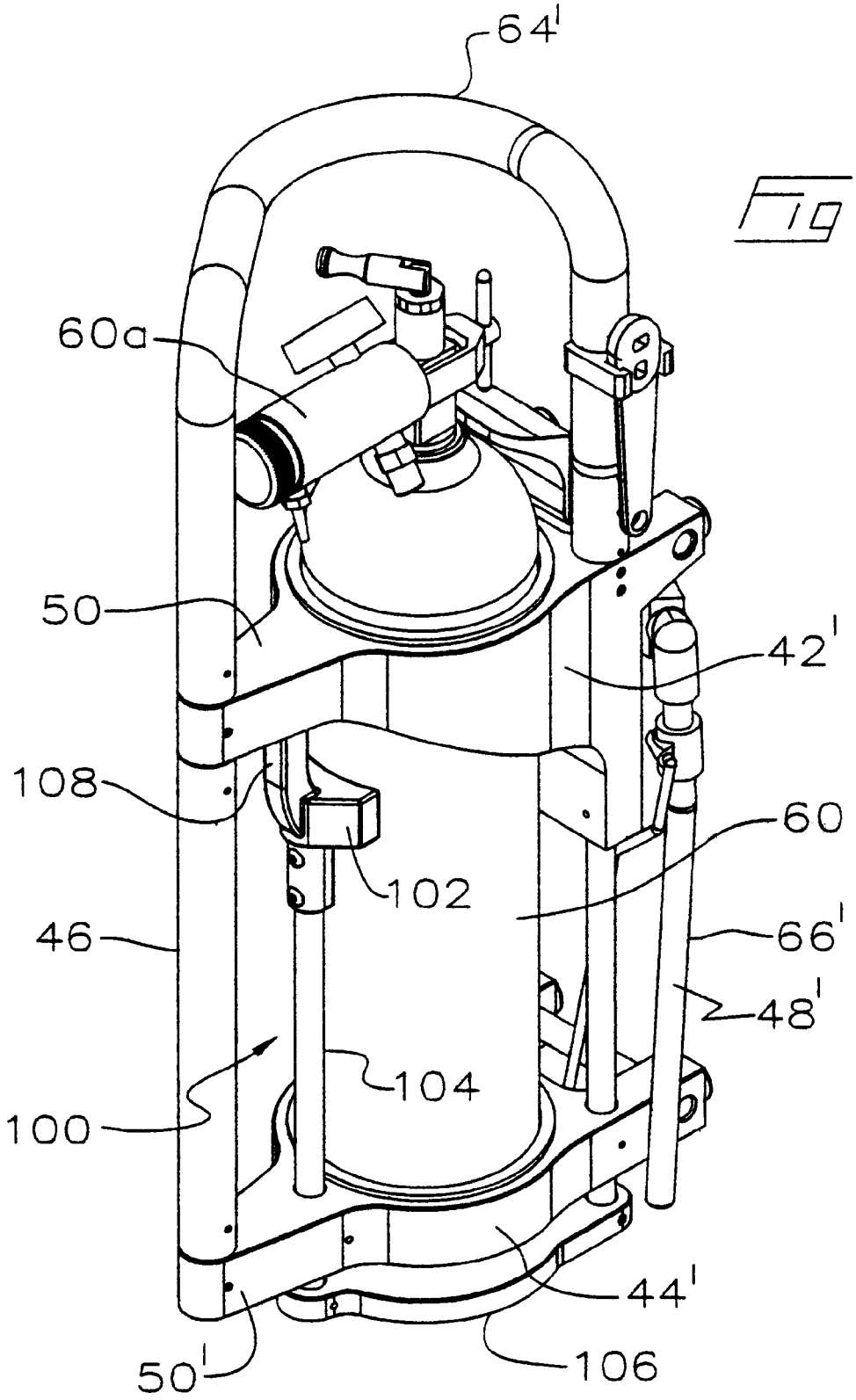
FIG. 6 is, in perspective view, an alternative embodiment of the canister retaining frame of FIG. 1.

Some alternative embodiments, not intended to be limiting, of the apparatus for releasing upper pin 56*a* from engagement with pawl 22 are illustrated in FIGS. 5, 5*a* and 5*b* and in FIGS. 13–19. For example in FIG. 5, release levers 76 are mounted to the ends of spindle 24 so as to extend outwardly of cover plate 36. Rotation of release levers 76 in direction C correspondingly rotate both spindle 24 in direction B and pawl 22 so as to release pin 56*a* from engagement in cavity 22*b* behind pawl flange 22*a*. Other embodiments are discussed further below.

Figure 1:
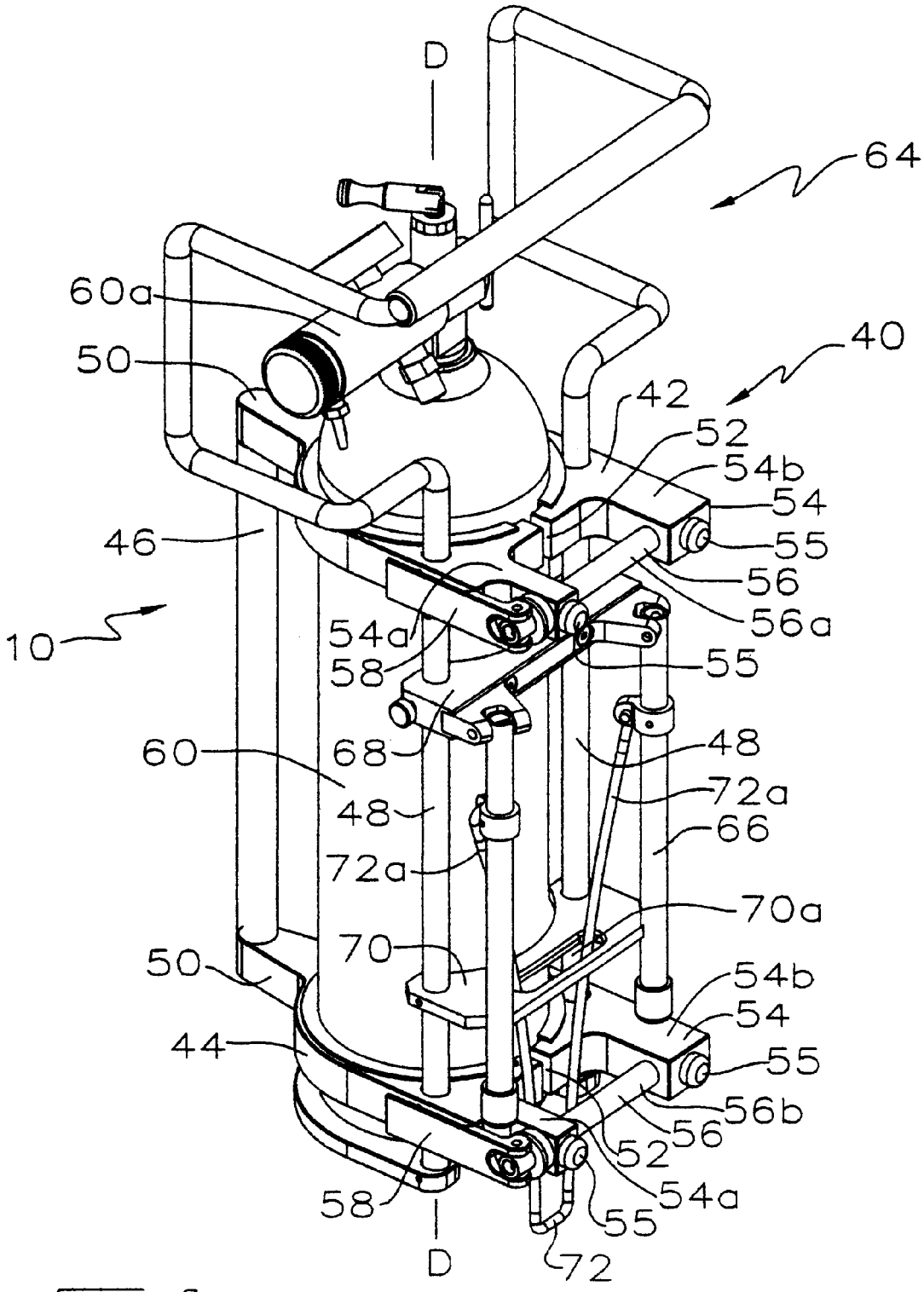
FIG. 1 is an isometric view of the retaining, carrying and supporting apparatus of the present invention.

As seen in FIGS. 6–10, the canister retaining flame and gas flow regulator guard 64 which protects for example regulator 60*a* on cylinder 60 is, without intending to be limiting, modified from that discussed above and illustrated in FIG. 1. Thus, as may be seen, the rectangular gas flow regulator guard 64 of FIGS. 1–3 is modified in the embodiment of FIGS. 6–10 into the single arcuate loop of gas flow regulator guard 64'. Guard 64' extends from the upper end of handle 46 above protrusion 50 so as to extend initially parallel to handle 46 so as to clear regulator 60*a*, and then curves over and around the regulator and its associated components and around the cross-sectional profile of the tank, cylinder or canister 60 so as to loop down onto, and to be mounted to the end of, one side of collar 42'. Collar 42' is mounted snugly annularly around the regulator end of cylinder 60. The lower or opposite end of cylinder 60 is mounted snugly within collar 44', collar 44' supporting on protrusion 50' the end of handle 46 opposite to gas flow regulator guard 64'.

Figure 7:
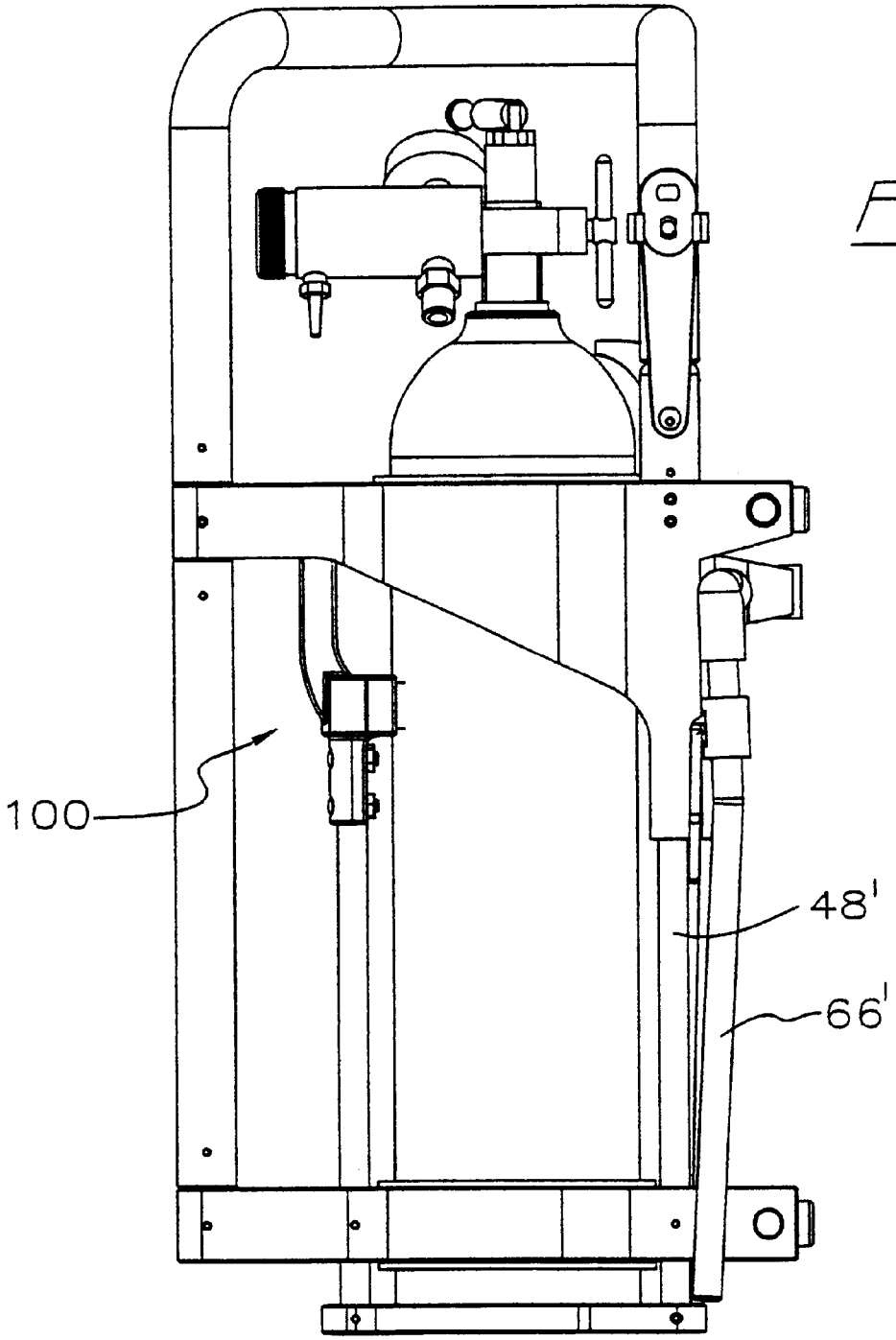
FIG. 7 is, in side elevation view, the canister retaining frame of FIG. 6.
Figure 8:
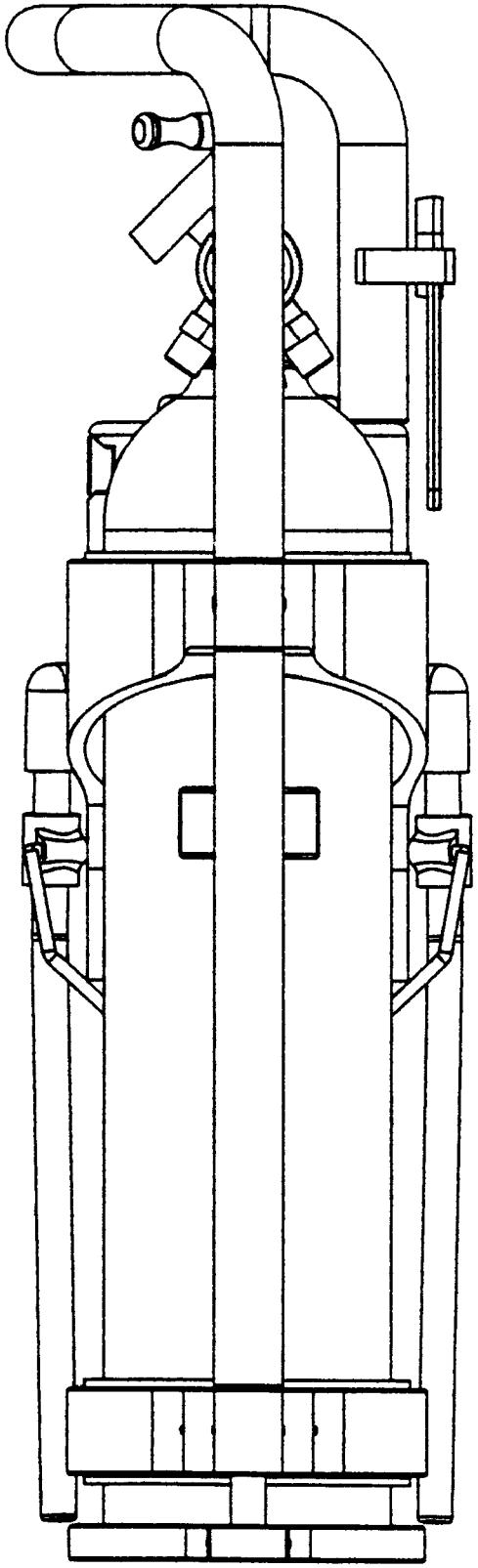
FIG. 8 is, in front elevation view, the canister retaining frame of FIG. 6.
Figure 9:
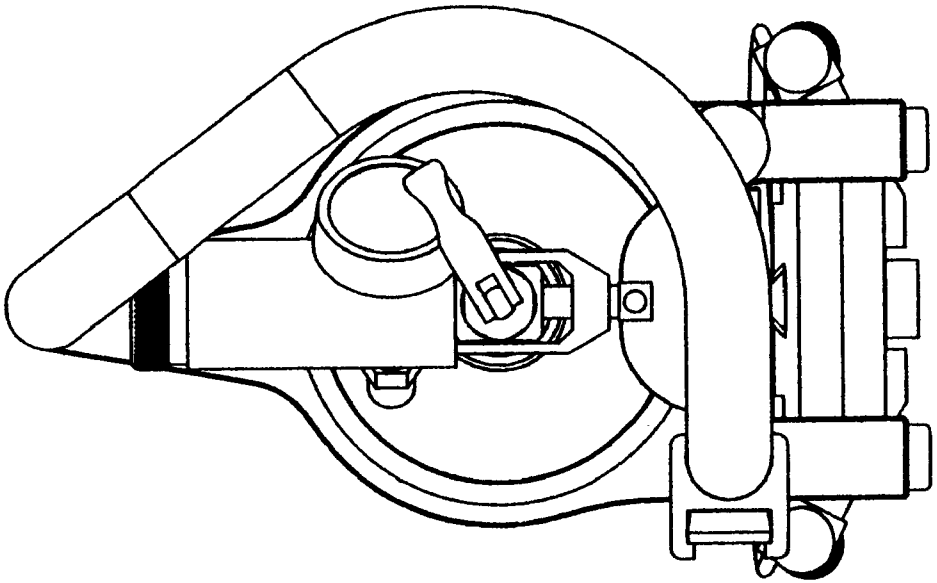
FIG. 9 is, in plan view, the canister retaining, frame of FIG. 6.
Figure 10:
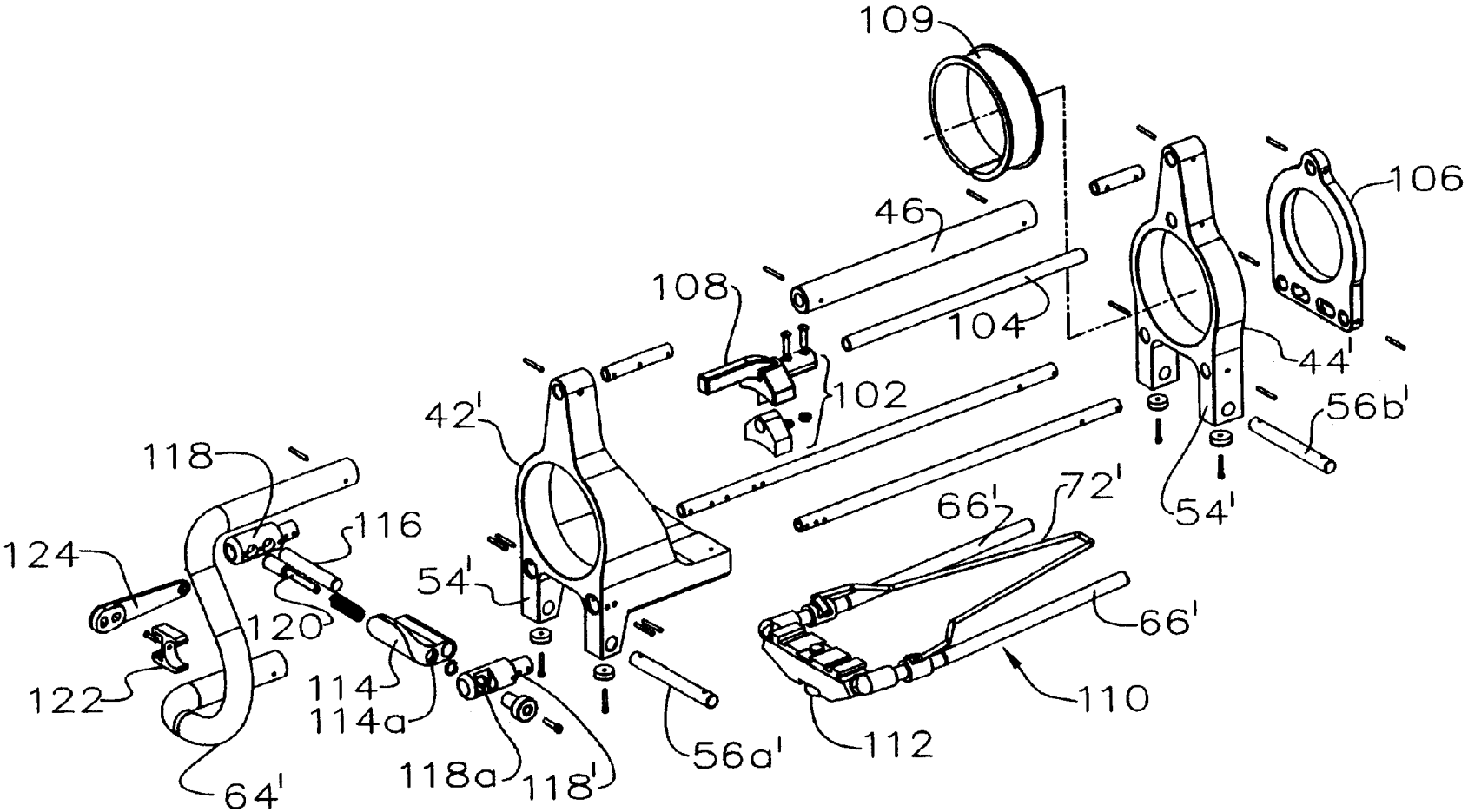
FIG. 10 is, in exploded view, the canister retaining frame of FIG. 6.

In this embodiment, collars 42' and 44' may assist in preventing rotation of cylinder 60 relative to the handle and gas flow regulator guard by the snug mounting of cylinder 60 within the collars. However, because of non-uniform diameters of cylinder 60 for example as between D and E size steel or aluminium tanks, an auxiliary rotation restraining device may be provided, such as the selectively releasable canister restraint 100, for inhibiting both rotation and sliding of the canister from the cavity. One such device, as best seen in FIG. 7, relies on a friction pad 102 which is resiliently urged against the side of cylinder 60 by the bending moment applied by a bar or shaft 104 cantilevered upwardly from its rigid mounting in the base of protrusion 50' where the protrusion intersects collar 44'. Shaft 104 is, in the embodiment illustrated, journalled through a hole in the base of protrusion 50' so as to extend into contact with, and is rigidly mounted to, a base plate 106 mounted parallel to and underneath collar 44'. The thickness of friction pad 102 when engaged against the side of cylinder 60, may slightly deflect or bend shaft 104 so that friction pad 102 exerts a force against the side of cylinder 60 sufficient that the friction between the two surfaces resists the rotation of cylinder 60 about its longitudinal axis D. This then maintains the orientation of, for example, regulator 60*a* protected underneath the protective penumbra afforded by gas flow regulator guard 64'. A handle 108 may be mounted to friction pad 102 or, for example, the end of shaft 104 so that an operator may pull on handle 108 to urge handle 108 and friction pad 102 towards handle 46 thereby releasing the frictional engagement of the friction pad against the cylinder. This allows the cylinder to be changed or reoriented as necessary. Because of the variation in the marketplace between cylinder diameters, in order to provide a snug fit of the collars around the canister, spacing sleeves 109, as seen in FIG. 10, may be provided for fitment between the collars and canister. The sleeves would be of sufficient thickness so as to provide a snug fit.

A pair of spacing tubes 48' are rigidly mounted in parallel spaced apart array between collars 42' and 44' so as to rigidly support the collars. The collars are thus supported spaced apart from one another by handle 46 and tubes 48'. The length of handle 46 and tubes 48' are such that cylinders of different length, for example D and F sizes, may be accommodated. Again, an automatically deploying bi-pod leg assembly, for example modified by shortening from a commercially available golf bag tripod leg assembly such as manufactured by Exim Golf of New York, N.Y., may be employed. Thus, as before, with the assembly adjusted relative to collar 42', and releasably mounted thereto for example by means of bolt 112 engaging one of an array of bolt holes (not shown) on tile back of collar 42', placing base plate 106 onto the ground drives the connecting rod structure 72' upwardly relative to the base plate so as to deploy the tripod legs 66' outwardly of the retaining frame into their deployed position as in FIG. 2. By use of the releasable mounting provided for example by means of bolt 112, bi-pod leg assembly 110 may be remounted higher up along the back of collar 42' so as to disengage the bottom of rods 72' from touching the ground when base plate 106 is resting on the ground. In this way, the deploying of legs 66' is disabled.

A releasable slide-inhibiting arm 114 may be mounted at the upper end of collar 42'. Arm 114 is pivotable on pin 116 between supporting posts 118 so as to be rotatable between an open position allowing extraction of cylinder 60 from its journalled mounting in collars 42' and 44', and a closed position where the curved end of the arm may be rotated over the end of cylinder 60 so as to restrain movement of cylinder 60 along its longitudinal axis relative to collars 42' and 44'. Arm 114 may be releasably lockable into its closed position retaining the cylinder and preventing longitudinal sliding within the collars for example by means of a spring-loaded pin or bolt 120 arrangement between posts 118 and 118' so as to restrain the pivoting rotation of latch arm 114 about pin 116 by journalling of pin 120 through hole 114*a* so as to releasably lock into mating engagement with a corresponding hole 118*a* on post 118'.

A tank valve wrench holder 122 may be mounted to one side of gas flow regulator guard 64' so as to provide a convenient storage and holding location for a tank valve wrench 124.

As before, upper and lower pins 56*a'* and 56*b'* are mounted in supporting yokes 54' in collars 42' and 44' respectively. The yokes may have rubber fee 55 for supporting frame 40 when laid down. Pin 56*b'* as before mates with supporting arm 12*b*, which as shown may also be a parallel pair of hooked flanges, and pin 56*a'* mates into latch receiving arm 12*c*, which also may be a parallel pair of flanges, of mounting bracket 12 so as to releasably mount retaining frame 40 and canister 60 for convenient storage, transportation and use.

Figure 11:
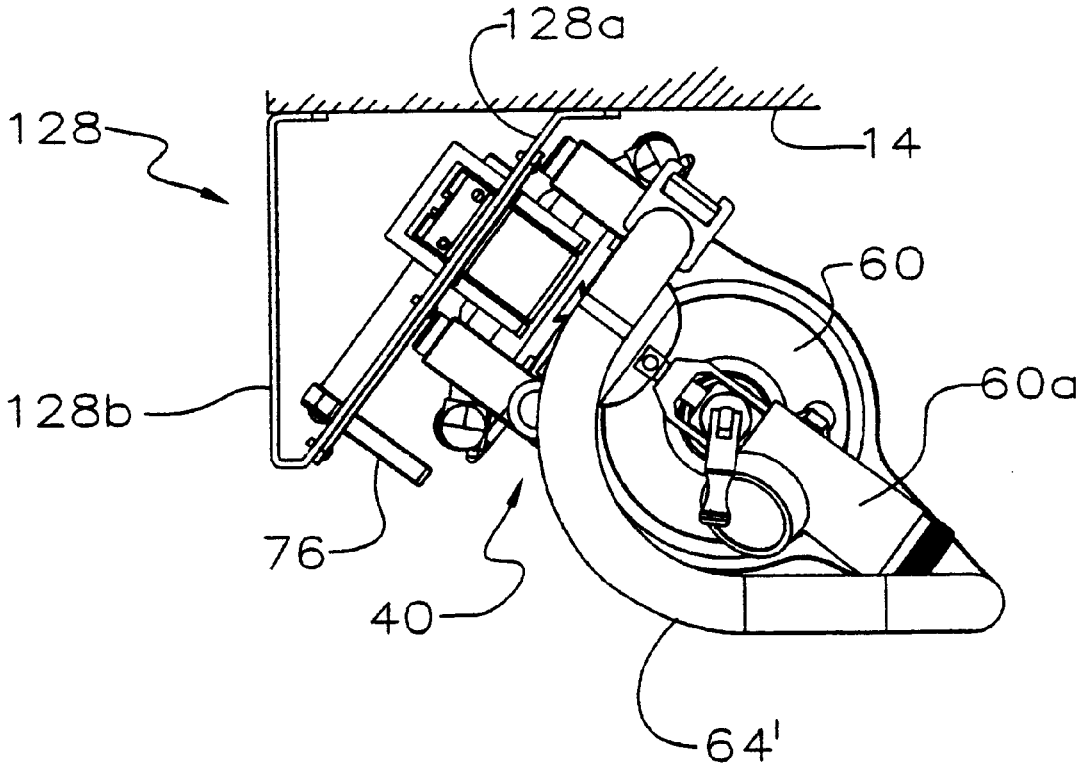
FIG. 11 is, the canister retaining frame of FIG. 6 mounted to an angled supporting bracket using an alternative embodiment of the mounting bracket of FIG. 5*a*.
Figure 12:
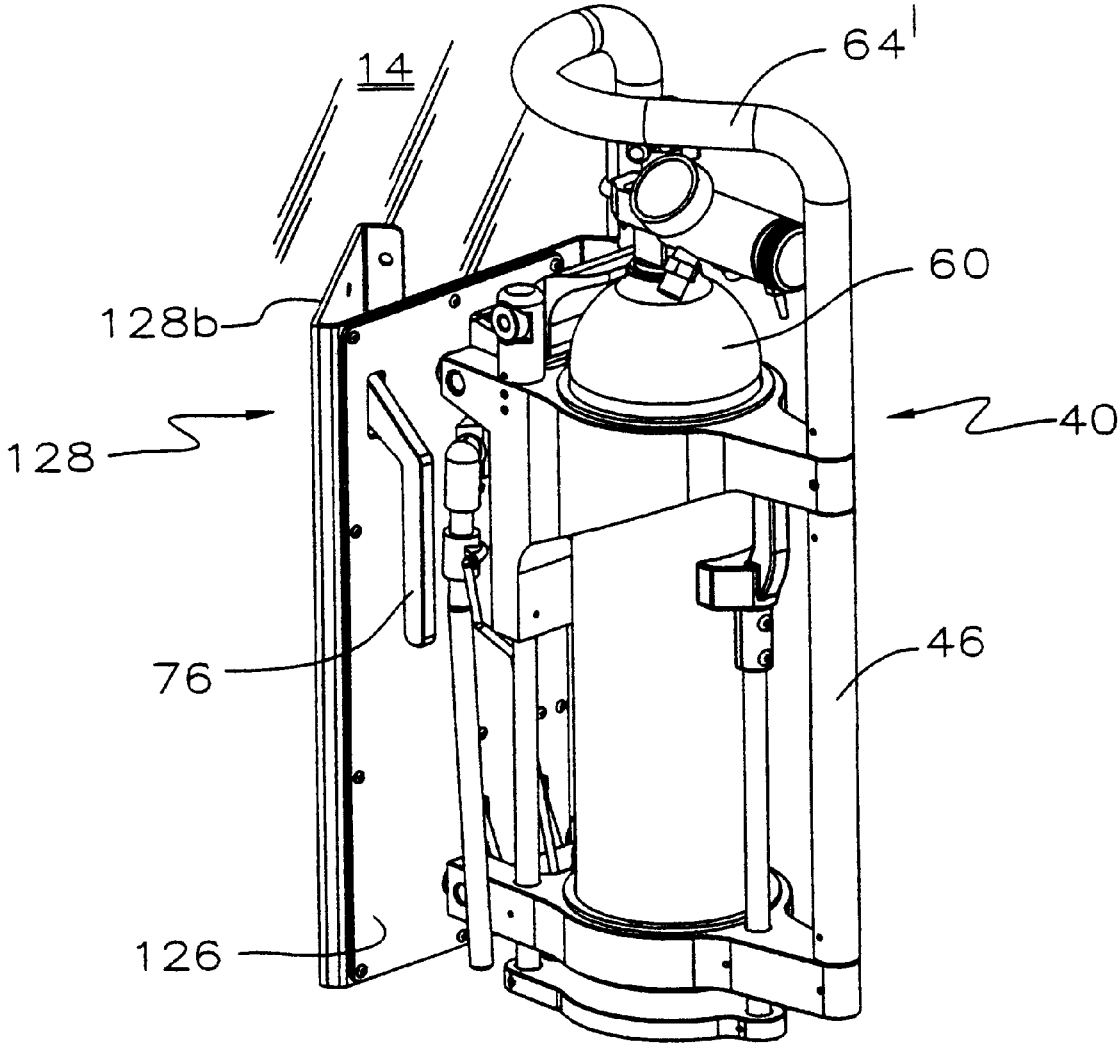
FIG. 12 is, in perspective view, the canister retaining frame mounted to an angled supporting bracket of FIG. 11.
Figure 13:
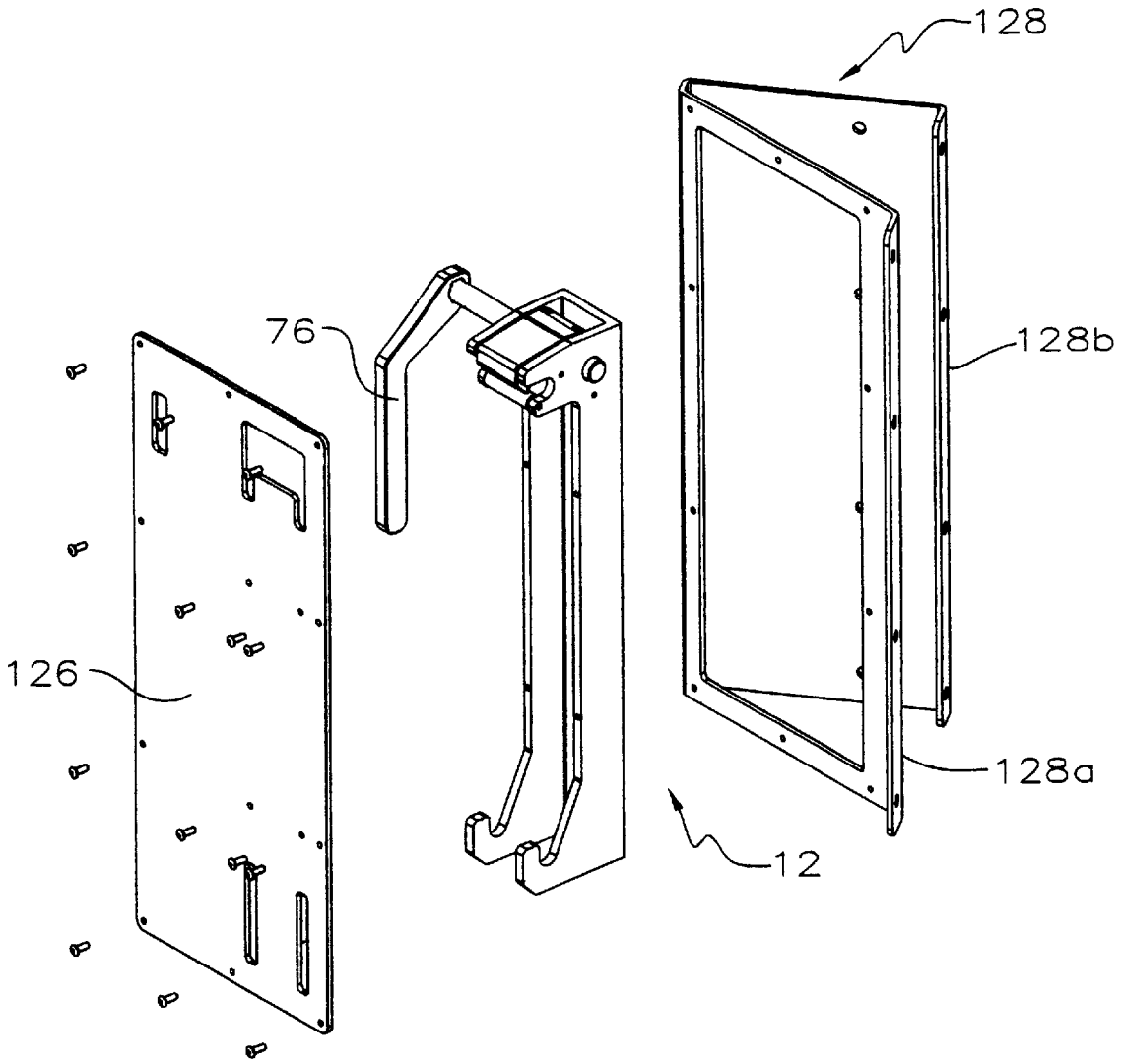
FIG. 13 is, in exploded view, the angled supporting bracket and mounting bracket of FIG. 11.

In a further embodiment of the mounting brackets of FIGS. 4, 5 and 5*a*, and again without intending to be limiting, the mounting bracket 12 of FIG. 5*b* is mounted behind a plate 126 in the wedge-shaped cavity defined by the front supporting frame 128 and the backing plate 128*b* of angled supporting bracket 128. Thus as seen in FIGS. 11 and 12, a retaining frame 40 and canister 60 such as described in relation to FIGS. 6–10, may be mounted to mounting bracket 12, when mounting bracket 12 is mounted within angled supporting bracket 128, so that the canister and retaining frame combination is angled or inclined towards and along inside surface 14. Thus retaining frame 40 and canister 60 are less intrusive into the working space within, for example, the back of an emergency vehicle, and may for example provide for ease of retrieving the canister through the open door of the emergency vehicle. The release mechanism used to release retaining frame 40 from mounting in mounting bracket 12 may be similar to the release mechanism of FIG. 5*b* with the exception that only one release handle 76 is provided because the mounting of retaining, frame 40 and canister 60 inclined towards inside surface 14 blocks access to one side of mounting bracket 12. The use of curved handle 64' eases grasping of the canister and retaining frame from any angle about the longitudinal axis of the canister, and thus inclining the retaining frame using bracket 128 does not necessarily adversely impact ease of manipulation of the retaining frame from inside the vehicle.

Figure 14:
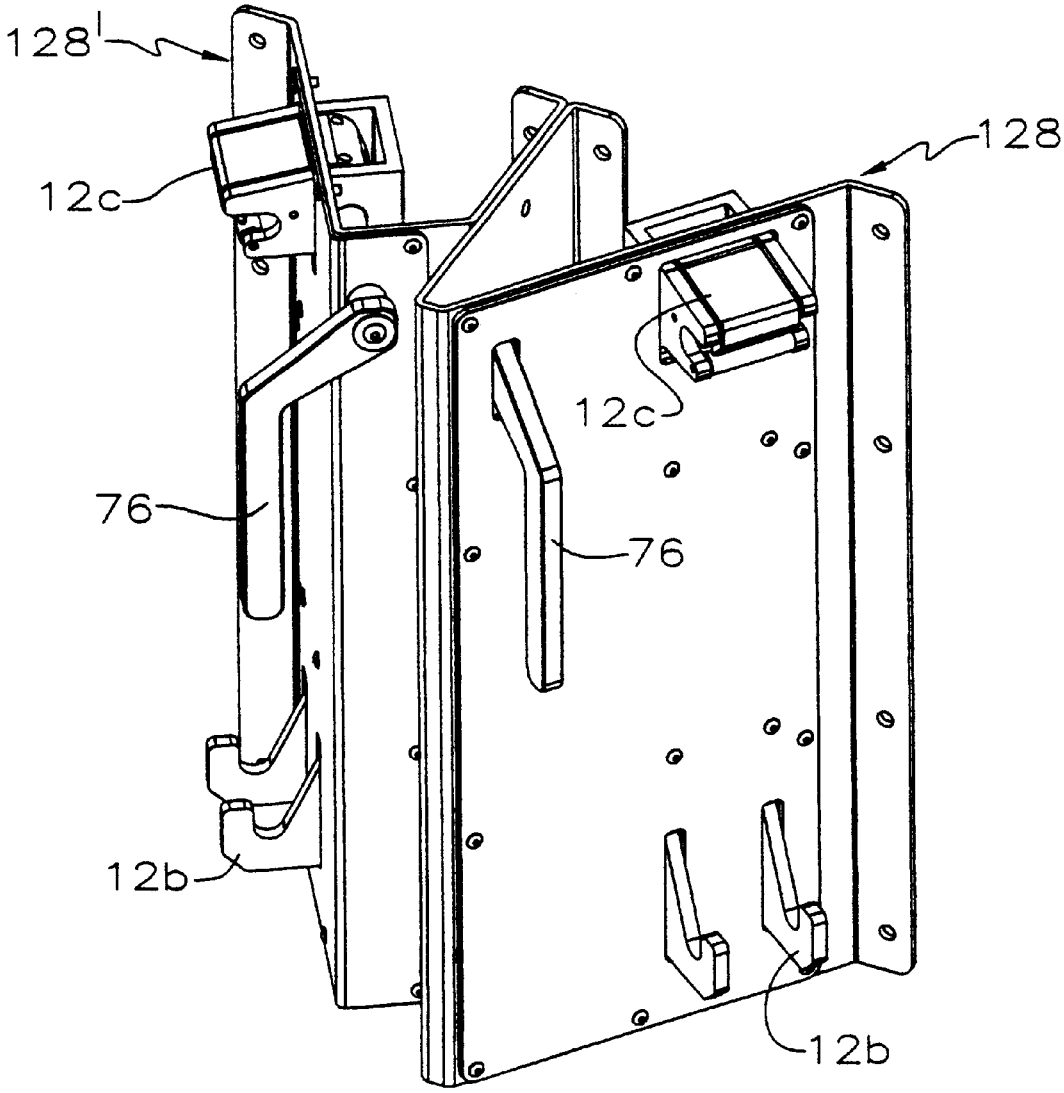
FIG. 14 is, in perspective view, a pair of back-to-back angled supporting brackets and their corresponding canister retaining frame mounting brackets.
Figure 15:
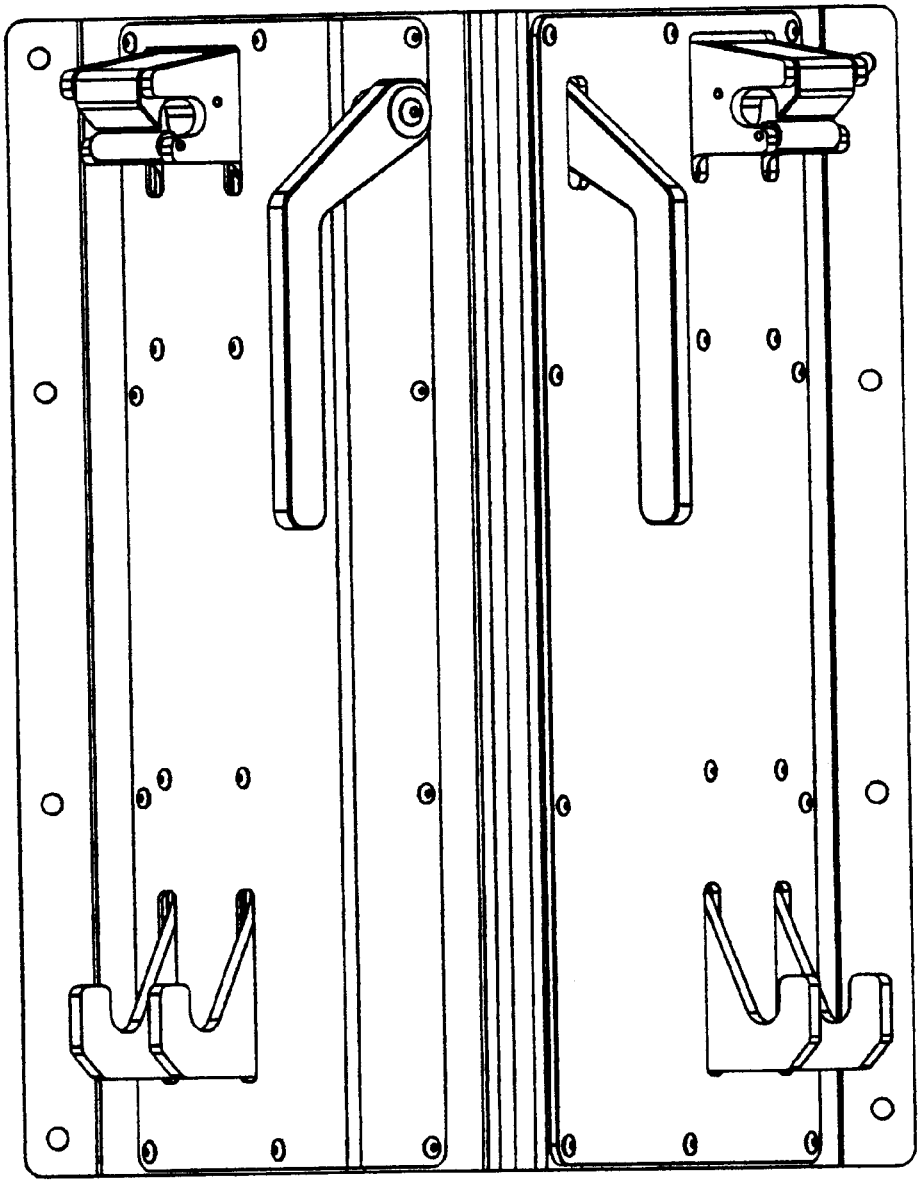
FIG. 15 is, in front elevation view, the pair of back-to-back angled supporting brackets of FIG. 14.
Figure 16:
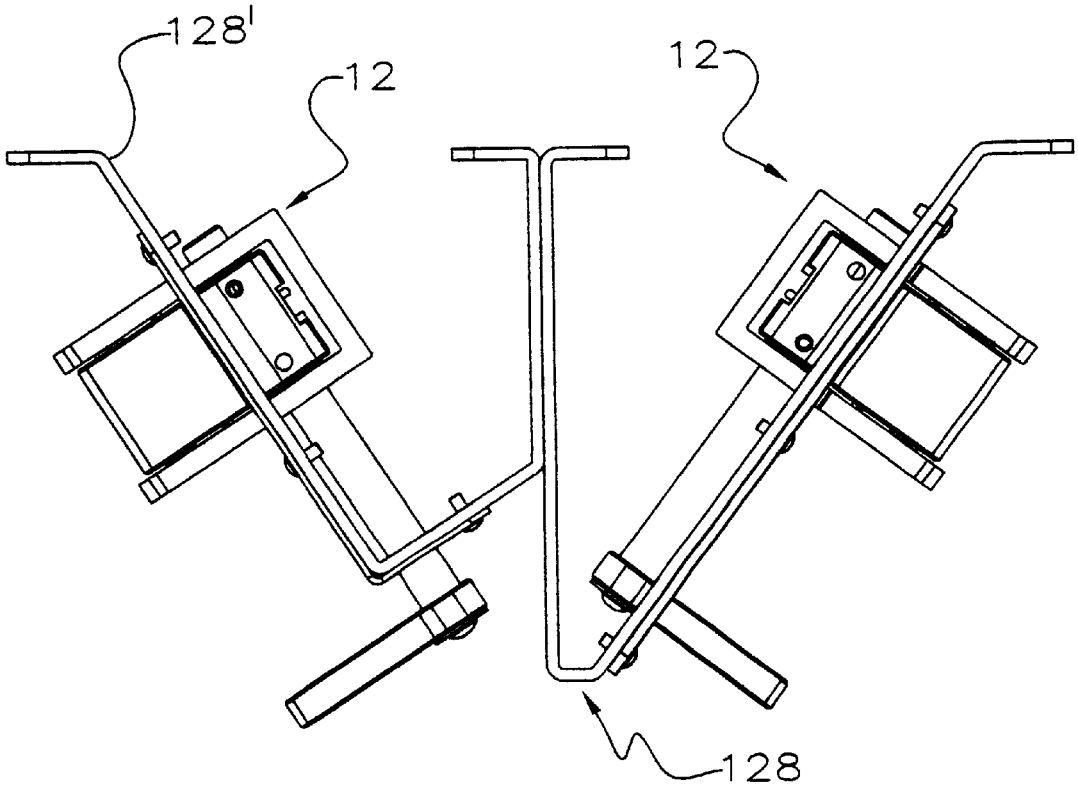
FIG. 16 is, in plan view the angled supporting brackets of FIG. 15.

As seen in FIGS. 14–16, angled supporting brackets 128 may be slightly modified so as to be used modularly as for example in tile back-to-back paired mounting of supporting bracket 128 and modified supporting bracket 128', modified to allow the protrusion of handle 76 from the side of a corresponding mounting bracket 12. Brackets 128 are also reversible, to accommodate left or right handed access, by inverting brackets 128 and reversing their face plates.

Figure 17:
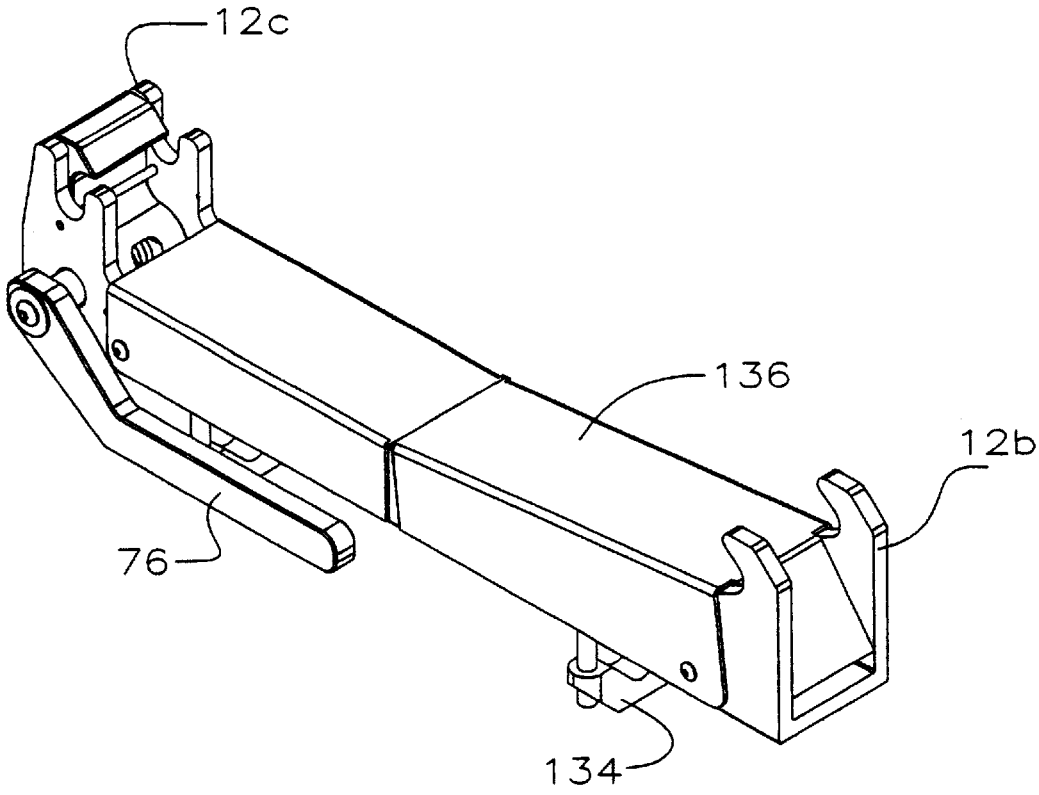
FIG. 17 is, in perspective view, an alternative embodiment of the mounting bracket of FIG. 13 adapted for mounting to a stretcher frame member.
Figure 18:
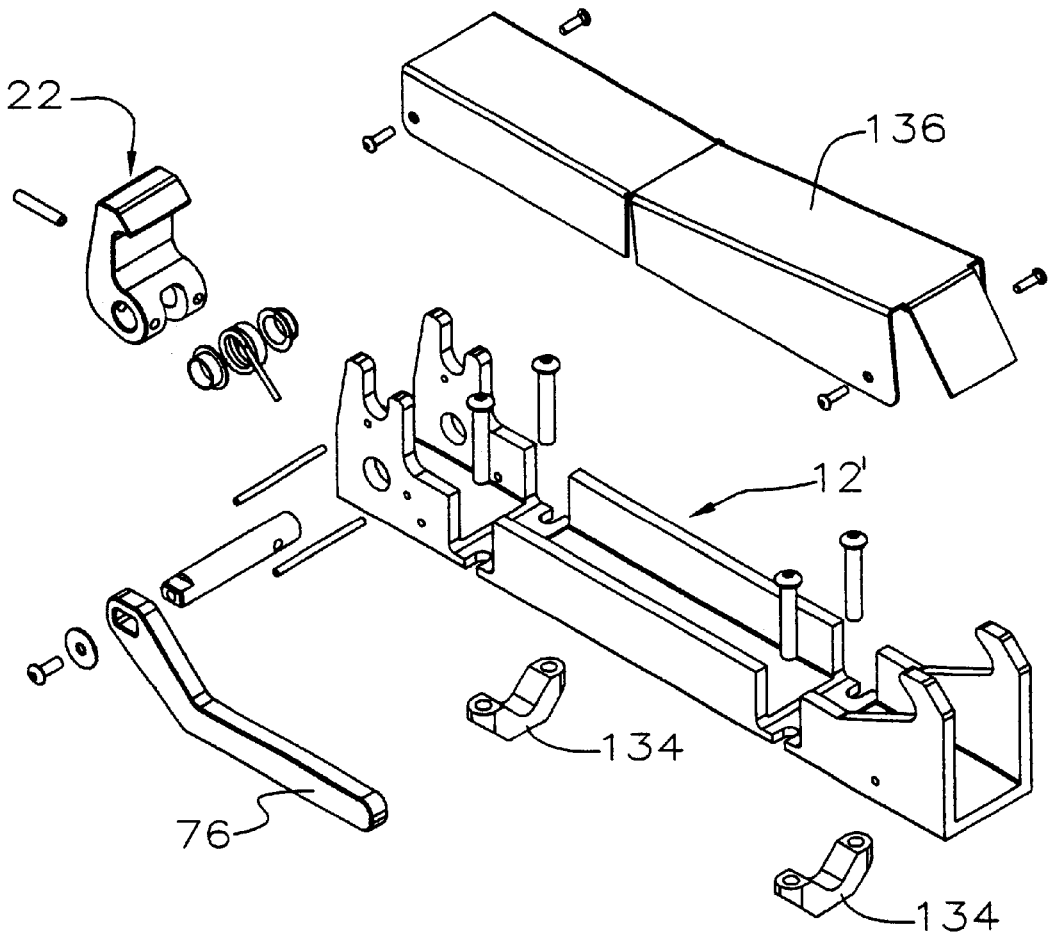
FIG. 18 is, in exploded view, the mounting bracket of FIG. 17.
Figure 19:
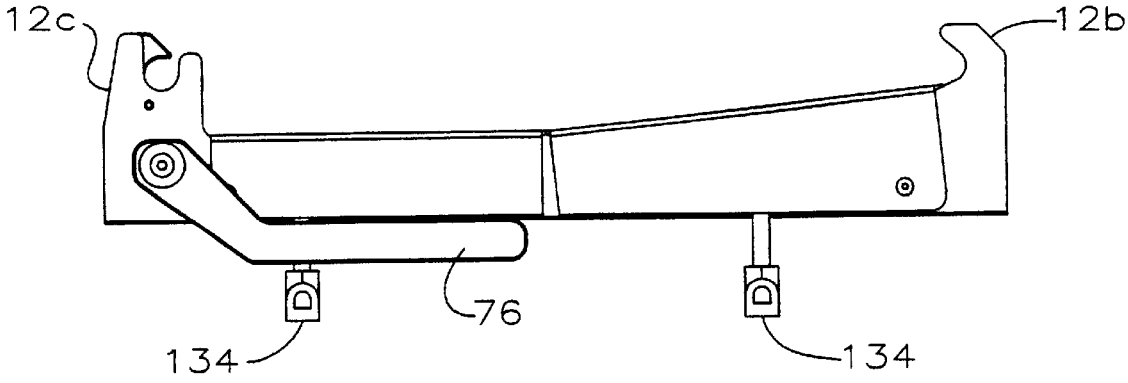
FIG. 19 is, in side elevation view, the mounting bracket of FIG. 17.
Figure 20:
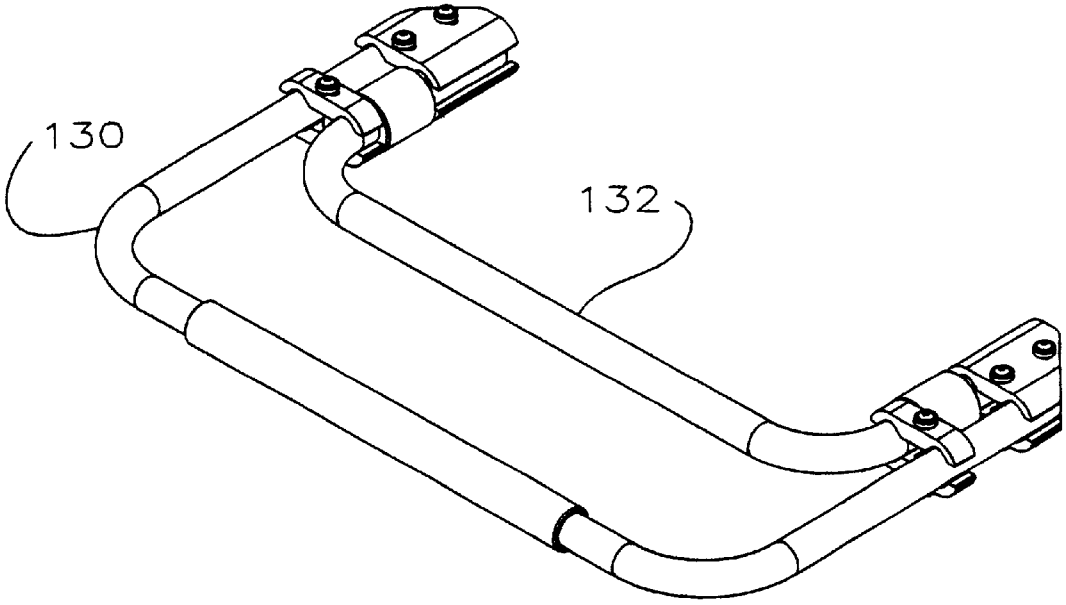
FIG. 20 is, in perspective view, a stretcher frame extension member mounted to one end of a stretcher frame.

As seen in FIGS. 17–19, mounting bracket 12 may be adapted for mounting to a tubular member rather than a planar supporting surface, where such a tubular member may be a frame member of a stretcher. For example, the tubular member may be the "U" shaped stretcher frame extension 130 such as seen in FIG. 20 mounted to one end of a conventional stretcher tube frame 132. As better seen in FIG. 18, mounting bracket 12' again supports handle 76 operatively connected to pawl 22 so as to release retaining frame 40 from its mating with mounting bracket 12'. The back side of mounting bracket 12' is mounted on to a member such as extension 130 by the use of, for example, a pair of "U" shaped couplers 134 mountable to the back of mounting plate 12' so as to clamp a length of extension 130 between the couplers and the mounting bracket. Thus, by way of example, with extension 130 mounted to the head of an existing stretcher frame, and with mounting bracket 12' mounted along extension 130 so as to parallel the head of the stretcher, a retaining frame 40 and canister 60 may be quickly and releasably mounted on to the stretcher extension 130 for ease of supplying an on-going supply of gas to a patient on the stretcher. In the example of FIGS. 17–19, mounting bracket 12' is enclosed within a housing 136 along its length.

As will be apparent to those skilled in the art in the light of the foregoing disclosure, many alterations and modifications are possible in the practice of this invention without departing from the spirit or scope thereof. Accordingly, the scope of the invention is to be construed in accordance with the substance defined by the following claims.

What is claimed is:

1. A quick release supporting apparatus for a canister comprising:

a mounting bracket mountable to a rigid support, a rigid, canister retaining frame releasably mountable into mating engagement with said mounting bracket, at least one latch cooperating between said mounting bracket and said retaining frame for said releasable mounting into mating engagement of said retaining frame with said mounting bracket, a manually operable release actuator cooperating with said at least one latch for selective actuation of said at least one latch to release said retaining frame from said mounting bracket, said retaining frame defining a rigid cavity having an opening for receiving a gas canister substantially completely into said cavity, a portion of said retaining frame providing a carry handle for carrying of said retaining frame by a user when the canister is mounted in said cavity and said retaining frame is dismounted from said mounting bracket, wherein said frame includes first and second collars, mounted parallel and spaced apart, corresponding first and second apertures defined by said collars being co-axial along a longitudinal axis of the canister when mounted journalled in said collars.

2. The apparatus of claim 1 wherein said retaining frame includes at least one selectively releasable canister rotation restraint for inhibiting rotation of the canister about its longitudinal axis.

3. The apparatus of claim 1 wherein said portion of said retaining frame is generally opposite said mounting bracket, when said retaining frame is mounted to said mounting bracket.

4. The apparatus of claim 1 further comprising a rigid guard mounted to said retaining frame at a first end of said retaining frame corresponding to said opening to said cavity, said guard extending over said opening so as to protect a gas flow regulator mounted on the canister.

5. The apparatus of claim 1 wherein rigid, parallel first and second cross-members are mounted respectively to said first and second collars, and wherein said at least one latch includes a latch mounted to said mounting bracket at a first end thereof said mounting bracket having at a second, opposite end a hooked supporting arm, said first and second cross members for releasable mating with said latch and said supporting arm respectively.

6. The apparatus of claim 5 wherein said latch is a single upper latch disposed substantially vertically above a support arm extending from said bracket, said support arm adapted to releasably engage and support a lower end of said frame, an upper end of said frame adapted to releasably engage said latch.

7. The apparatus of claim 6 further comprising a resilient compression fit auxiliary latch cooperating with said at least one latch so as to provide a safety backup latch for controlled release of said retaining frame from mounting to said mounting bracket.

8. The apparatus of claim 1 wherein said at least one latch is mounted to said mounting bracket so as to protrude cantilevered therefrom, and wherein said mounting bracket mounts to a rear surface of the rigid support when the rigid support is an apertured wall so as to extend said at least one latch through corresponding apertures in the wall to protrude from the opposite front surface of the wall for releasable latched mating with said rigid frame.

9. The apparatus of claim 8 further comprising a cantilevered support arm.

10. The apparatus of claim 1 further comprising at least one selectively releasable canister restraint for inhibiting sliding of the canister from said cavity.

11. The apparatus of claim 1 further comprising an angled wall mount adapted for mounting to the rigid support when the rigid support is a wall, said mounting bracket mounted to said wall mount along a surface of said wall mount inclined relative to the wall so as to incline said retaining frame towards and along the wall when said retaining frame is mounted to said mounting bracket.

12. The apparatus of claim 1 further comprising a resilient compression fit auxiliary latch cooperating with said at least one latch so as to provide a safety backup latch for controlled release of said retaining frame from mounting to said mounting bracket.

* * * * *